US006485340B1

(12) United States Patent
Kolb et al.

(10) Patent No.: US 6,485,340 B1
(45) Date of Patent: Nov. 26, 2002

(54) ELECTRICALLY CONTROLLED SHIFT AND THROTTLE SYSTEM

(75) Inventors: Richard P. Kolb, Prairie View, IL (US); Gaylord M. Borst, Sebring, FL (US); Anthony P. Prince, deceased, late of Waukegan, IL (US), by Shirley M. Prince, administatrix

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 09/192,801

(22) Filed: Nov. 16, 1998

(51) Int. Cl.[7] ..... B63H 21/22; B60K 41/00
(52) U.S. Cl. ..... 440/84; 440/86; 440/87
(58) Field of Search ..... 440/84, 86, 87; 114/146

(56) References Cited

U.S. PATENT DOCUMENTS

| | | | | |
|---|---|---|---|---|
| 2,702,615 A | | 2/1955 | Morse | |
| 2,760,133 A | | 8/1956 | Shaw et al. | |
| 3,121,415 A | | 2/1964 | Anderson et al. | |
| 3,140,689 A | | 7/1964 | Miner | |
| 3,749,048 A | | 7/1973 | Jones et al. | 115/34 |
| 3,918,256 A | | 11/1975 | Ashleman | 60/221 |
| 3,919,510 A | | 11/1975 | Barnes | 200/61 |
| 4,022,078 A | | 5/1977 | Malott | 74/475 |
| 4,401,866 A | | 8/1983 | Kaminski et al. | 200/61 |
| 4,519,266 A | | 5/1985 | Reinecke | 74/471 |
| 4,836,809 A | * | 6/1989 | Pelligrino | 440/2 |
| 5,080,619 A | * | 1/1992 | Uchida et al. | 440/84 |
| 5,214,977 A | | 6/1993 | Nagafusa | 74/480 |
| 5,222,901 A | | 6/1993 | Burkenpas | 440/86 |
| 5,318,466 A | * | 6/1994 | Nagafusa | 440/84 |
| 5,492,493 A | * | 2/1996 | Ohkita | 440/86 |
| 5,848,369 A | * | 12/1998 | Kobelt | 701/50 |

FOREIGN PATENT DOCUMENTS

| | | | | |
|---|---|---|---|---|
| EP | 0 418 431 A1 | * | 3/1991 | 440/84 |
| JP | 3-61196 | * | 3/1991 | |

* cited by examiner

*Primary Examiner*—Sherman Basinger
(74) *Attorney, Agent, or Firm*—Timothy J. Ziolkowski; J. Mark Wilkinson

(57) ABSTRACT

An electrically controlled shift and throttle system for a watercraft having multiple control stations is disclosed. The system has a number of control units having an elongated lever arm which can be moved in forward and reverse directions for shifting the transmission among forward, neutral, and reverse operating modes, as well as controlling the throttle of the engine for varying the operating speed thereof. The control units are electrically connected to a controller which also is electrically connected to a shift gear motor and throttle motor. Switches associated with each of the control units enables one of the control units to be selected as a master control unit and the nonselected control units then operate as slave units. During operation, the angular position of the master control unit lever arm is duplicated in the nonselected control units so that all control unit lever arms have the same angular orientation. A warm-up switch enables the throttle motor to be operated to vary the operating speed of the engine without shifting the transmission out of the neutral position.

27 Claims, 4 Drawing Sheets

ELECTRICALLY CONTROLLED SHIFT AND THROTTLE SYSTEM

BACKGROUND OF THE INVENTION

The present invention generally relates to a throttle and shift control system for marine craft and more particularly for such a system for marine craft having two or more control stations at which throttle and shift control functionality is desired.

SUMMARY OF THE INVENTION

Many larger marine craft will often have more than one control station where an operator can control the craft. If full operation is to be carried out at each control station, then the shifting of the transmission among forward, neutral, and reverse operating modes must be possible, as must control of the throttle system of the engine or engines. There have been mechanical systems available in the past which carry out this functionality, but the mechanical linkages were often complex and cumbersome, particularly if the distances between control stations and the engine were great. Also, such mechanically complex systems for multiple control stations were usually quite expensive.

Accordingly, it is a primary object of the present invention to provide an improved shift and throttle control system for a marine craft having multiple control stations which is capable of providing control from any one of the stations, but which does not require the mechanical interconnection among the control stations and the engine or engines.

Another object of the present invention is to provide such an improved shift and throttle control system whereby the operating mode and throttle control can be carried out by a single pivotable lever arm at each station.

Another object of the present invention is to provide such a system whereby the control station that is selected becomes the master station, which then controls the shift and throttle speed, and the other control stations are controlled to have their lever arms in substantially the same position as the master during operation.

A related object of the present invention is to provide a master control selection switch at each control station which enables each control station to be selected as the master, with all others being slaved control stations.

Yet another object of the present invention is to provide a shift and throttle control system which reduces the activation distance of mechanical linkage.

Still another object of the present invention is to provide such an improved system which includes an engine warm-up switch that can be activated and which enables the master control station to have throttle control only, with the operating mode being neutral.

BRIEF DESCRIPTION OF THE DRAWINGS

These and other features of the present invention will be more fully disclosed when taken in conjunction with the following Detailed Description of the Preferred Embodiment(s) in which like numerals represent like elements and in which.

DETAILED DESCRIPTION OF THE PREFERRED EMBODIMENT(S)

Broadly stated, the present invention has its maximum effectiveness for use with an electrical system for controlling the shifting of a transmission and controlling the throttle for an engine of a marine craft, such as a boat, where two or more operating stations are provided. However, many of the principals of the invention are also applicable to a boat having a single operating station. For a multi-operating station boat, it is desirable for each operator station to have full control of the operating mode and speed of the boat and, to this end, the system of the present invention permits shifting to be achieved among the forward, neutral, and reverse operating modes and also the operating speed of the engine to be controlled. An operator can select any one of the control units to be the master control unit and the remaining control units are then automatically operated as slave control units as is desired. With the electrical interconnection of the control units and engine(s), rather than the prior art mechanical-type interconnection, all control units have pivotable lever arms with an angular orientation that is identical regardless of whether the control unit is a master or a slave control unit at the time. This enables master control to be changed from one control station to another, and can be done merely by activating a switch that designates a control station as the master control station. The system is also adapted for use in controlling more than one engine, if desired, and the simplicity of the design enables the operator to use a single elongated pivotable lever arm to both shift and control the throttle so as to control the operating speed of the engine or engines.

Figure 1:
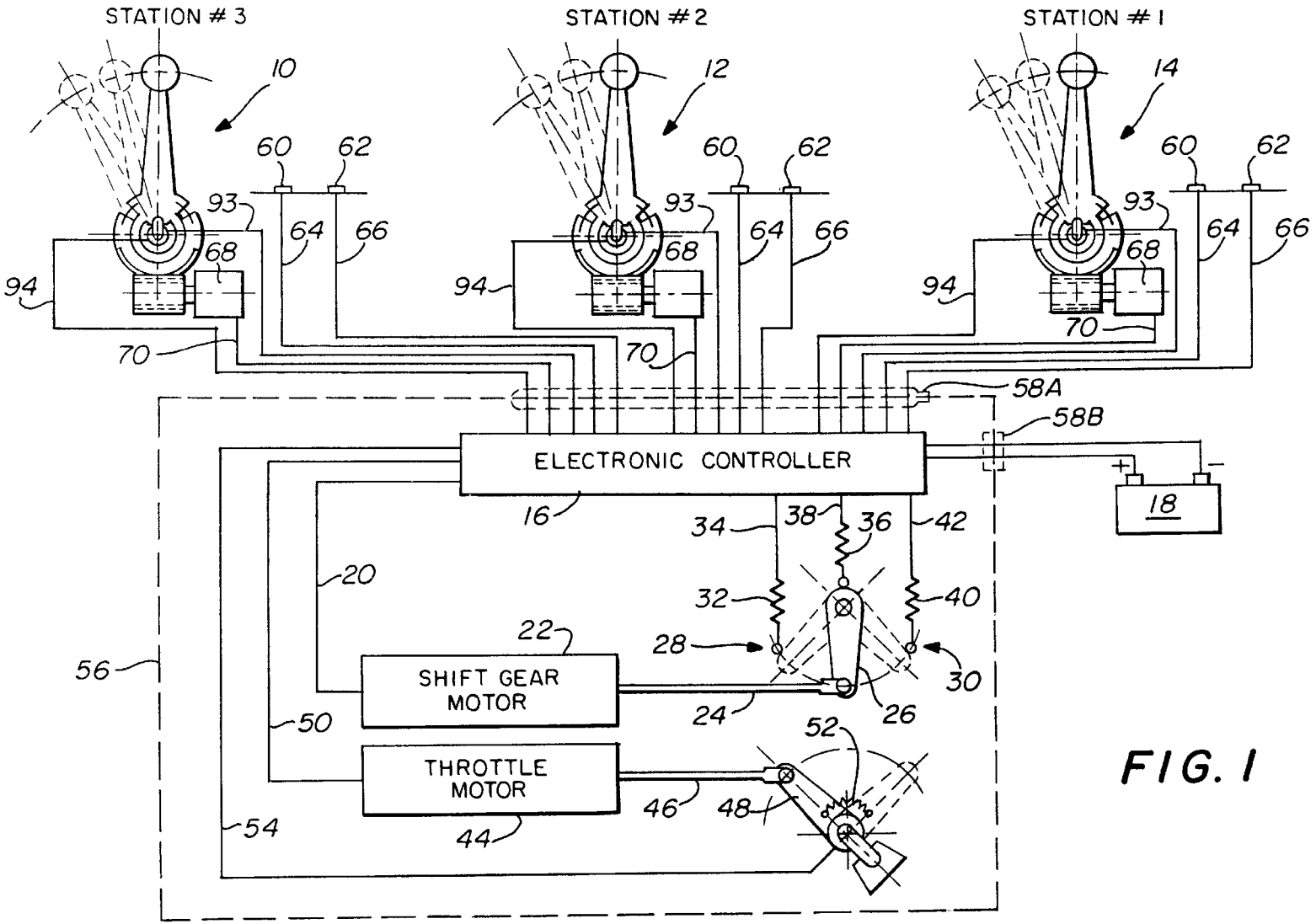
FIG. 1 is a schematic diagram of the present invention, particularly illustrating the shift and throttle control system of the present invention.

Turning now to the drawings, and particularly FIG. 1, a schematic diagram of the system embodying the present invention is shown and includes three control units, indicated generally at 10, 12, and 14, which are electrically connected to a controller 16 that is preferably a microprocessor having internal memory and analog-to-digital conversion capability, The controller has several inputs and outputs and is powered by a battery 18. The controller has an output line 20 that is connected to a shift gear motor 22 which is adapted to drive a linkage 24 to a gear-shifting lever 26 that is shown in the neutral position, but which can be moved to a forward position, indicated generally at 28, or a reverse position, indicated generally at 30. A suitable position-sensing device 32, such as a microswitch, a resistor network, or potentiometer tap, provides an input to the controller 16 via line 34, which indicates when the forward operating mode is selected. Similarly, second position-sensing device 36, such as a resistor network, a microswitch, or potentiometer tap, together with line 38, provides an input to the controller 16 for determining when the linkage is in the neutral position. A third position-sensing device 40, such as a potentiometer tap, a microswitch, or a resistor network, is coupled by line 42 to the controller 16 provides a signal that the transmission is in the reverse operating mode. The controller is also connected to a throttle motor 44 that has a drive linkage 46 for adjusting a throttle linkage 48 of the engine for varying the operating speed. The throttle motor is operated via line 50 and a potentiometer 52 associated with the throttle linkage 48 provides a feedback signal on line 54 to the controller so that the position of the throttle linkage 48 is known.

It will be appreciated that the electronic controller 16, shift gear motor 22, and throttle motor 44 may be physically placed or located at any suitable location. It is especially advantageous that the shift gear motor 22 and the throttle motor 44 be very close to the gear shift lever 26 and throttle linkage 48 respectively so as to keep the activation distance of the mechanical linkage to a minimum. One preferred location for shift gear motor 22 and throttle motor 44 would be under the outboard motor or engine cowling 56 as is indicated by dashed lines in FIG. 1. It may also be convenient to locate the electronic controller 16 under the cowling. If throttle motor 44 and shift gear motor 22 are located under the cowling, only electrical wiring needs to be routed to the outboard motor or engine, and disconnection can be made by one or more watertight connectors, such as connectors 58A and 58B.

Figure 2:
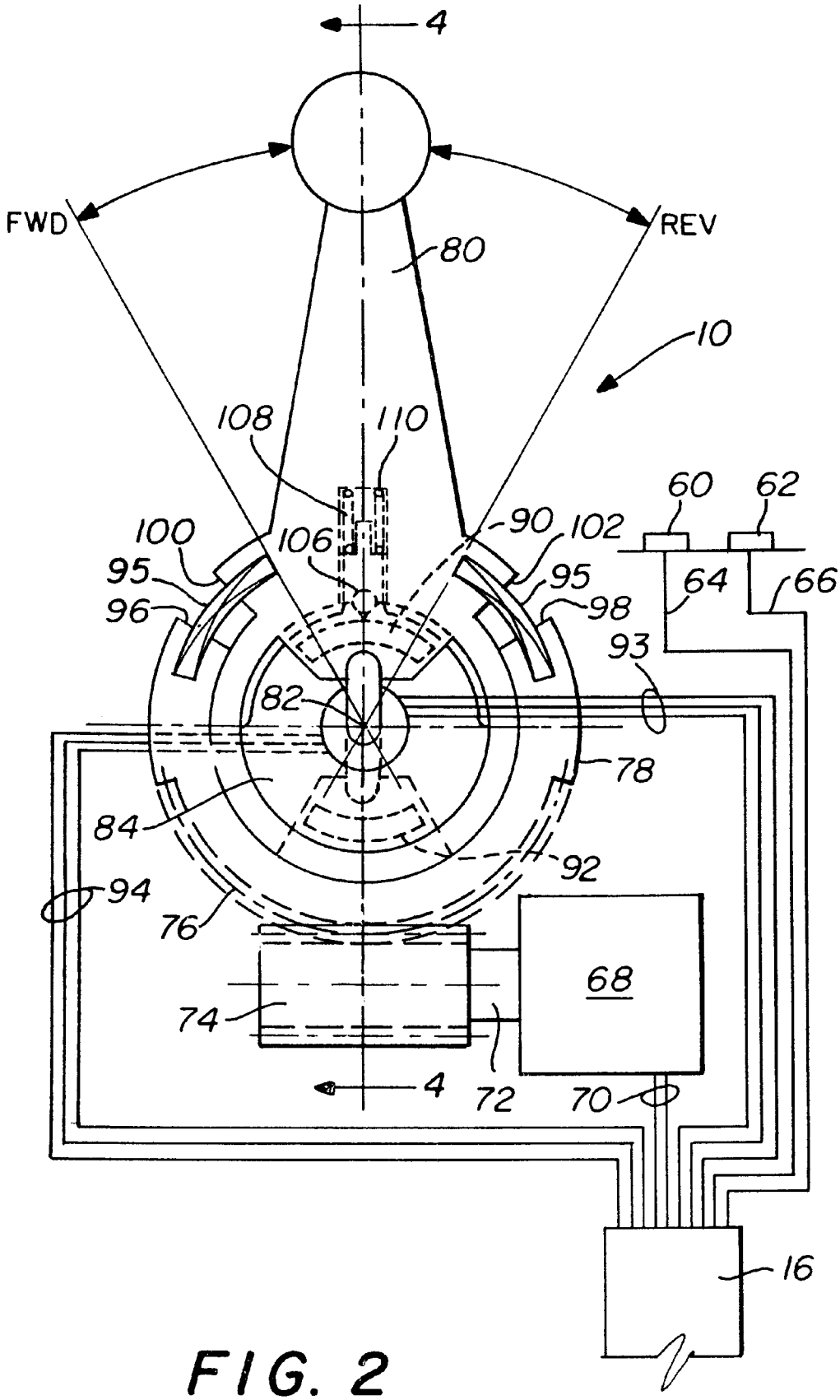
FIG. 2 is an enlarged plan view of a single control unit.

There are several inputs and outputs to the control units 10, 12, and 14, which are identical and therefore will only be described for a single control unit. As best shown in FIG. 2, each control unit has two switches 60 and 62 that are connected to the controller 16 via respective lines 64 and 66. The switch 60 is intended to be used to select the particular control unit to be a master control unit. When a control unit, such as control unit 10, is selected by actuating its associated switch 60, it becomes the master control unit and all others, such as control units 12 and 14, will then become slave control units that cannot be used to control the operation of the system until they are selected by operating their switch 60. The switch 62 is for use in warming up the engine or engines of the watercraft and, more particularly, for increasing the throttle or operating speed of the engines during warm-up without changing the operating mode from neutral to either the forward or reverse operating mode. The activation of the switch 62 disables the operating mode shifting by the control unit by any switch or well-known means such as, for example, disabling or interrupting the control signals on line 20 from the controller to the shift gear motor 22 and enables the control unit to increase the operating speed of the engine by moving the lever arm without shifting the transmission.

Figure 5:
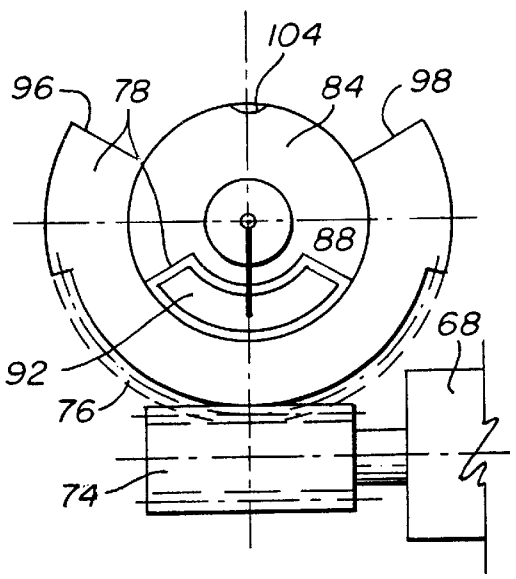
FIG. 5 is a right side view of the rotatable base portion of the control unit shown in FIG. 4 including a worm gear mechanism of the present invention.
Figure 4:
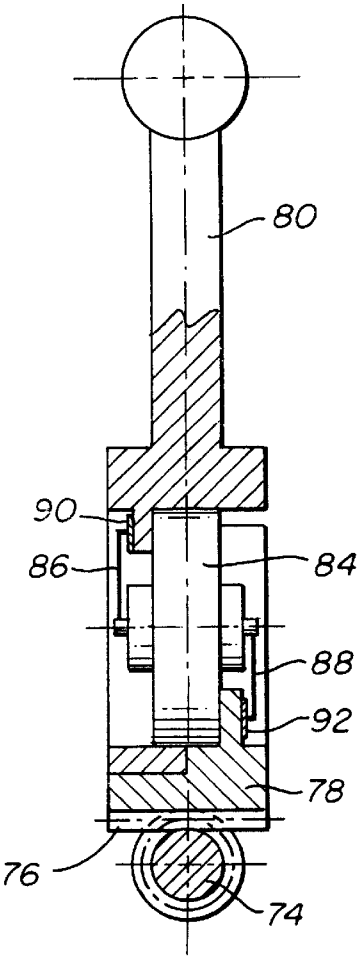
FIG. 4 is a sectional view taken generally along the line 4—4 in FIG. 2.
Figure 8:
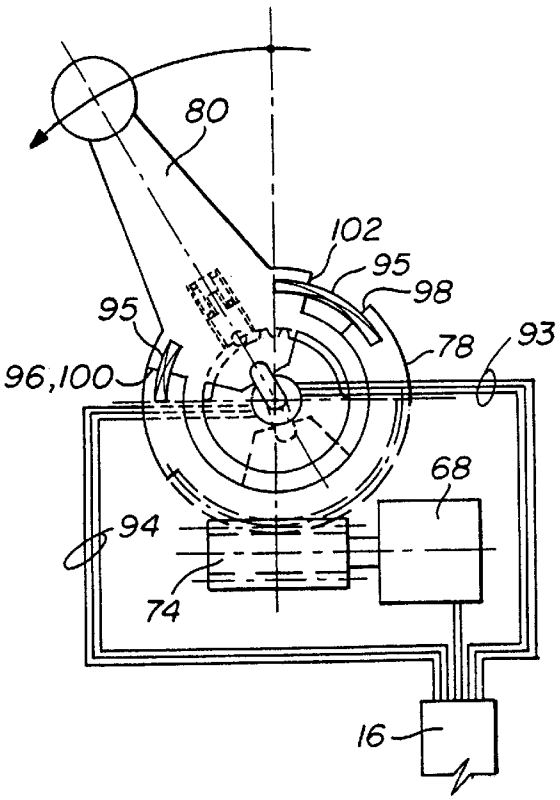
FIG. 8 is a side view similar to FIG. 2 and illustrating the master control unit being moved to increase the operating speed.
Figure 7:
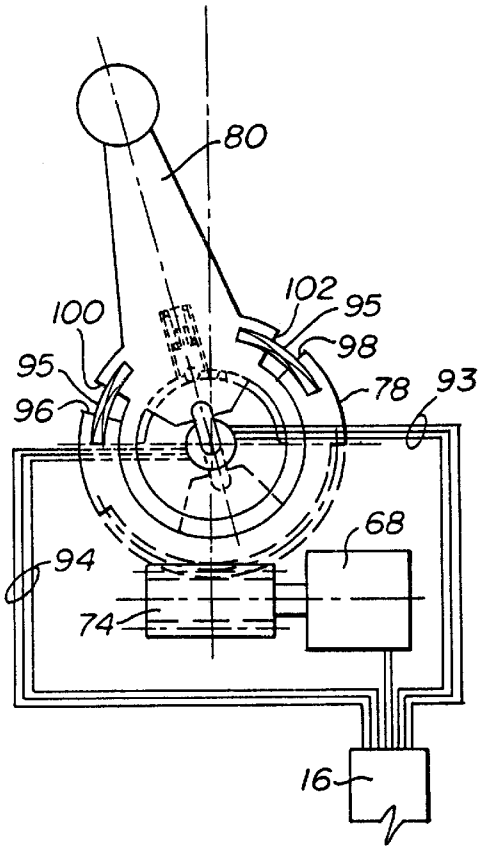
FIG. 7 is a side view similar to FIG. 2, but illustrating a slave control unit moving after having completed its movement to the same position as the master control unit shown in FIG. 6.
Figure 6:
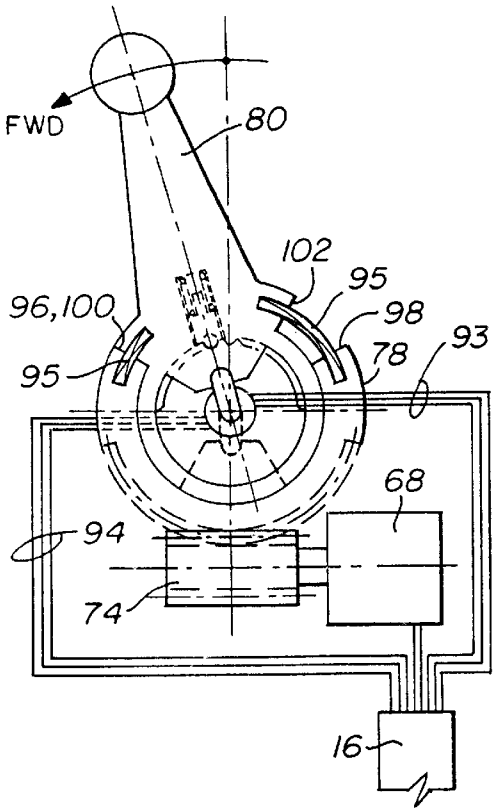
FIG. 6 is a side view similar to FIG. 2 illustrating a selected master control unit being advanced into forward operating mode from a neutral mode.

Each of the control units, such as control unit 10, has a drive motor 68, which is controlled by lines 70 from the controller 16, and the drive motor 68 has an output shaft 72 carrying a worm gear 74 that meshes with worm gear 76 located on a rotatable base portion 78. The control unit 10 has an elongated lever arm 80 which is pivotable around an axis 82 and the lever arm 80 is pivotable relative to the pivotable base portion 78 and is also pivotable with the pivotable base portion 78. There is a stationary base portion 84 that has upper and lower wiper assemblies 86 and 88 (see FIGS. 3, 4, and 5) that respectively cooperate with resistive surfaces 90 and 92 for providing a variable resistance value that is proportional to the angular position of the lever arm 80 and the pivotable base portion 78. The wiper assemblies 86 and 88 are attached to the stationary base portion 84 so that pivotable movement by the lever arm 80 will cause the resistance value in circuit to be changed to provide either a variable voltage or current depending upon the type of circuit that is utilized, with both types of circuits being known to those of ordinary skill in the art. Referring to FIGS. 6, 7, and 8, three lines 93 are shown to extend from the wiper assembly 86 and resistive surface 90 to the controller 16, and lines 94 extend from the wiper assembly 88 and resistive element 92 to the controller 16. The schematic diagram of FIG. 1 simply shows these lines as single lines 93 and 94.

As is best shown in FIGS. 6, 7, and 8, the lever arm 80 is pivotable relative to the pivotable base portion 78 and both the lever arm 80 and pivotable base portion 78 are pivotable relative to the stationary base portion 84 having the wiper mechanisms 86 and 88 attached thereto. A pair of coil springs 95 are provided to interconnect opposite sides of the lover aim 80 with the pivotable base portion 78 and each spring has one end fitted within a recess of each of these components. The pivotable base portion 78 has radially oriented surfaces 96 and 98 which are adapted to contact similar radial surfaces 100 and 102 of the lever aim 80. As the lever arm is rotated to the left, the surfaces 100 and 96 can be made to contact one another and, similarly, if the lever arm is rotated to the right or clockwise direction, the surfaces 102 and 98 may be moved into contact with one another. As shown in FIGS. 2 and 5, the stationary base portion 84 has a recess 104 located in the top center thereof and a small ball 106 is provided and is biased in a downward position by a spring 108 located in a recess 110 of the lever arm 80 and is ill a center position when the ball 106 fits into the depression 104. The ball 106, biased by spring 108, provides a detente and physical indication when the lever arm 80 is in a center position. Therefore, a slight additional forward force is required for the initial movement of the handle from the center position.

Figure 3:
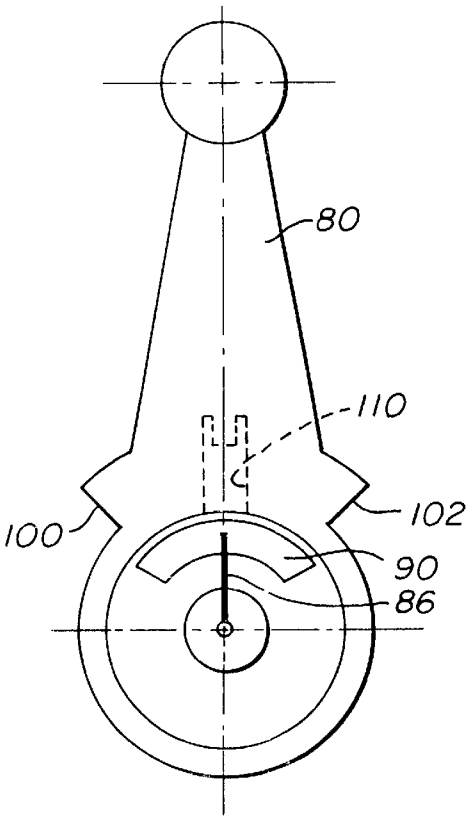
FIG. 3 is a side view of a portion of the control unit, particularly illustrating the privotable lever arm of the control unit.

During operation and referring to FIGS. 3 and 6, if the lever arm 80 is pivoted to the left as shown, the position of the resistive surface 90 moves relative to the wiper mechanism 86 to generate a different voltage (or current value) that is input to the controller 16 indicating that the transmission has been shifted to the forward direction and the controller actuates the shift gear motor 22 into the forward position Further movement to the left also is input to the controller 16 and the throttle motor 44 is actuated to move the throttle linkage to increase the operating speed of the engine. However, as soon as the resistance value changes from the neutral position, the controller activates the drive motor 68 and causes it to move the pivotable base portion 78 to a position whereby the voltage generated by the resistive surface 92 and wiper mechanism 88 creates a voltage that is substantially identical to the voltage generated by the position of the lever arm 80. This results in the lever arm 80 and pivotable base portion 78 reaching the position shown in FIG. 7. Further leftward pivoting of the lever arm 80 will change the voltage generated and will similarly cause the throttle motor 44 to change the throttle linkage to increase the speed of the engine, as shown in FIG. 8. This will also result in the controller again actuating the drive motor 68 so as to cause the drive motor to move the pivotable base portion 78 to a position whereby to voltage generated by the resistive surface 92 and wiper mechanism 88 is substantially identical to the voltage generated by the resistive surface 90 and wiper mechanism 86.

While the above-described action is occurring with respect to the control unit that is selected as the master, it is important to understand that the controller 16 is applying the same drive signals to the drive motors 68 of the nonselected control units so that they will be repositioned in the virtually identical position as the selected control unit. In this manner, the control units of all control stations will be virtually identical so that if it is desired to change the selected one of the control stations and operate it as the master control station, all that is necessary is for the switch 60 to be activated at one of the previously nonselected or slave control units so that it will then become the master control station.

From the foregoing description, it should be understood that an improved electronically controlled shift and control system has been shown and described which offers many advantages over similar mechanical prior art systems. The system has the same operating characteristics as one which mechanically couples each of the control units, but is much easier to install and maintain. The interconnection of the control units is achieved merely by the electrical wires which extend from the control units to the controller 16 rather than unwieldy and cumbersome mechanical means. Similarly, the interconnection with the shift gear motor and the throttle motor is also achieved by electrical connections which offer similar simplicity and advantages.

The corresponding structures, materials, acts, and equivalents of all means or step plus function elements in the claims below are intended to include any structure, material, or act for performing the function in combination with other claimed elements as specifically claimed.

We claim:

1. Apparatus for controlling the shift and throttle systems of a marine craft having at least one engine with a throttle system and a transmission with a shift system for selecting one of forward, neutral, and reverse operating modes, the craft having at least two operator control stations, the shift system being of the type which has a shift gear linkage means for shifting a transmission among forward, neutral, and reverse operating modes, the throttle system having a throttle linkage means operably connected to the engine for controlling the operating speed of the engine, the apparatus comprising:

a first control unit located at a first operator control station and being adapted to generate electrical signals indicative of the operating speed and operating mode as a function of the position throw said control unit having a drive motor to selectively position the same responsive to positioning signals being received thereby;

a second control unit located at a second operator control station and being adapted to generate electrical signals indicative of the operating speed and operating mode as a function of the position thereof said second control unit having a drive motor to selectively position the same responsive to positioning signals being received thereby;

means associated with at least one of said control units for selecting one of said control units to be the master control unit for controlling the operating mode and operating speed;

a shift gear motor adapted to operate the shift gear linkage means to shift the transmission among operating modes responsive to electrical shift signals being applied thereto;

a throttle motor adapted to operate the throttle linkage means for controlling the operating speed of the engine; and processing means adapted to receive said signals from each of said control units and to generate said positioning signals and to generate said shift signals for operating said shift gear motor and said throttle motor;

said apparatus operating in a manner whereby selection of a lever control means enables an operator to position the same and select the operating mode and operating speed and generate said electrical signals and communicate them to said processing means, said processing means communicating positioning signals to said drive motor of the nonselected control unit for positioning the same in substantially the same position as the selected control unit.

2. Apparatus as defined in claim 1 wherein each of said control units comprises an elongated lever arm that is pivotable about an axis, said lever arm having a neutral position and adapted to be pivotable in a first direction for selecting a forward operating mode position and for increasing the operating speed proportionally as the amount the lever arm is pivoted in said first direction and pivotable in a second direction for selecting a reverse mode operating position and for increasing the operating speed proportionally as the amount the lever arm is pivoted in said second direction.

3. Apparatus as defined in claim 2 wherein said first and second directions are opposite one another.

4. Apparatus as defined in claim 3 further including a third control unit located at a third operator control station and being adapted to generate electrical signals indicative of the operating speed and operating mode as a function of the position thereof, said control unit having a drive motor to selectively position the same responsive to positioning signals being received thereby.

5. Apparatus as defined in claim 3 wherein each of said control units comprises:

a stationary base portion;

a pivotable base portion being supported by said stationary base portion for angular pivotable movement relative to said stationary base portion;

said elongated lever arm being supported by said stationary base portion for angular pivotable movement relative to both said stationary base portion and also said pivotable base portion;

at least one centering spring means for positioning said lever arm at a center position relative to said pivotable base portion in the absence of external force being applied to said lever arm;

first resistor means operably connected to said stationary base portion and said lever arm and providing a fir&a electrical value that is proportional to the angular position of said lever arm with respect to said stationary base portion, said first resistor means generating at least said operating speed signal responsive to said angular position of said lever arm; and second resistor means operably connected to said stationary base portion and said pivotable base portion and providing a second electrical value that is proportional to the angular position of said pivotable base portion with respect to said stationary base portion, said second resistor means generating said positioning signal responsive to said angular position pivotable base portion.

6. Apparatus as defined in claim 5 wherein each of said control units includes a worm gear and worm drive mechanism interconnecting its drive motor and its pivotable base portion.

7. Apparatus as defined in claim 6 wherein said processing means receives said operating speed signals from said first resistor means of said selected control unit, and generates said positioning signals and applies the same to all of said lever control units.

8. Apparatus as defined in claim 5 wherein said lever arm is pivotable through a predetermined arc relative to said pivotable base portion, and has a ball and detente mechanism operably associated between said lever arm and said pivotable base portion defining said center position.

9. Apparatus as defined in claim 8 wherein said spring means comprises a pair of coil springs being located on opposite sides of said lever arm and between said pivotable base portion and said lever arm, said springs being adapted to bias said lever arm to said center position.

10. Apparatus as defined in claim 1 further including a warm-up switch means to permit said control unit to control operating speed but prevent the gear shift motor from operating said gear shift lever to either reverse or forward modes responsive to said warm-up switch means being activated.

11. Apparatus for controlling the shift and throttle systems of a marine craft having an engine with a throttle system and a transmission with a shift system for selecting one of forward, neutral, and reverse operating modes, the craft having at least two operator control stations, the shift system being of the type which has a shift gear linkage means for shifting a transmission among forward, neutral, and reverse operating modes, the throttle system having a throttle linkage means operably connected to the engine for controlling the operating speed of the engine, the apparatus comprising:

a control unit located at each operator control station and being adapted to generate an electrical operating speed signal indicative of the operating speed and an electrical operating mode signal, each said control unit having a drive motor to selectively position the same responsive to an electrical positioning signal being received thereby;

means associated with each of said control units for selecting one of said control units to control the operating mode and operating speed;

a shift gear motor adapted to operate the shift gear linkage means to shift the transmission from one operating mode to another responsive to said operating mode signal being applied thereto;

a throttle motor adapted to operate throttle linkage means for controlling the operating speed of the engine responsive to an operating speed signal being applied thereto; and processing means adapted to receive said operating mode and operating speed signals from said selected control unit and to generate said positioning signal and to generate signals for selectively operating said Shift gear motor and said throttle motor;

said apparatus operating in a manner whereby selection of a lever control means enables an operator to position the same and select the operating mode and operating speed and generate said electrical operating speed and operating mode signals and communicate them to said processing means, said processing means communicating said positioning signal to at least said drive motor of the nonselected control unit for positioning the lever control means of the nonselected control unit in substantially the same position as the lever control means of the selected control unit.

12. Apparatus as defined in claim 11 wherein each of said control units comprises:

a stationary base portion for providing support for a pivotable base portion and an elongated lever portion;

a pivotable base portion that is angularly pivotable relative to said stationary base portion;

an elongated lever arm that is pivotable relative to said stationary base portion and is also pivotable relative to said pivotable base portion;

at least one centering spring means for positioning said lever arm at a center position relative to said pivotable base portion in the absence of external forces being applied to said lever arm;

first resistor means operably connected to said stationary base portion and said lever arm and providing a resistance value that is proportional to the angular position of said lever arm, said first resistor means generating said operating speed signal and said operating mode signal responsive to the angular position of said lever arm; and second resistor means operably connected to said stationary base portion and said pivotable base portion and providing a resistance value that is proportional to the arm position of said pivotable base portion, said second resistor means generating said positioning signal responsive to the angular position of said pivotable base portion.

13. Apparatus as defined in claim 11 wherein each of said control units comprises an elongated lever arm that is pivotable about an axis, said lever arm having a neutral position and adapted to be pivotable in a first direction for selecting a forward operating mode position and for increasing the operating speed proportionally as the amount the lever arm is pivoted in said first direction and pivotable in a second direction for selecting a reverse mode operating position and for increasing the operating speed proportionally as the amount the lever arm is pivoted in said second direction.

14. Apparatus as defined in claim 13 further including warm-up switch means adapted to permit said lever arm to control operating speed while preventing said operating mode from being in either reverse or forward modes responsive to said warm-up switch means being activated.

15. The apparatus as defined in claim 1 wherein said shift gear motor is located under an engine cowling.

16. The apparatus as defined in claim 15 wherein said throttle motor is located under the engine cowling.

17. The apparatus as defined in claim 16 wherein said processing means is located under the engine cowling.

18. The apparatus as defined in claim 1 wherein said throttle motor is located under an engine cowling.

19. The apparatus of claim 1 wherein said processing means is located under an engine cowling.

20. The apparatus of claim 11 wherein said processing means, said throttle motor, and said shift gear motor are located under an engine cowling.

21. Apparatus for controlling the shift and throttle systems of a marine craft having at least one engine with a throttle system and a transmission with a shift system for selecting one of forward, neutral, and reverse operating modes, the shift system being of the type which has a shift gear linkage means for shifting a transmission among forward, neutral, and reverse operating modes, the throttle system having a throttle age means operably connected to the engine for controlling the operating speed of the engine, the apparatus comprising:

a first control unit located at a first operator control station and being adapted to generate electrical signals indicative of the operating speed and operating mode as a function of the position thereof, said control unit having a drive motor to selectively position the same responsive to positioning signals being received thereby;

a shift gear motor adapted to operate the shift gear linkage means to shift the transmission among operating modes responsive to electrical shift signals being applied thereto;

a throttle motor adapted to operate the throttle linkage means for controlling the operating speed of the engine; and processing means adapted to receive said signals from said control unit and to generate said positioning signals and to generate said shift signals for operating said shift gear motor and said throttle motor;

said apparatus operating in a manner whereby a lever control means enables an operator to position the same and select the operating mode and operating speed and generate said electrical signals and communicate them to said processing means, said processing means communicating positioning signals to said drive motor.

22. An engine transmission and speed control unit for a marine craft comprising:

a lever arm having a first resistive surface element;

a pivotable base portion having a second resistive surface element, the pivotable base portion engageable with the lever arm;

a stationary base having a first wiper assembly and a second wiper assembly, the first wiper assembly in operational engagement with the first resistive element and the second wiper assembly in operational engagement with the second resistive surface element; and a drive motor configured to position the pivotable base portion with respect to one of the first and the second wiper assembly based on a position of the other of the first and the second wiper assembly with respect to a respective resistive surface element.

23. The engine transmission and speed control unit of claim 22 further comprising an electronic controller configured to receive a signal indicative of an angular position of the lever arm with respect to the stationary base portion based on a position of the first wiper assembly with respect to the first resistive surface element.

24. The engine transmission and speed control unit of claim 23 wherein the electronic controller is further configured to receive the signal based on one of a voltage and a current measured at the engagement of the first wiper assembly and the first resistive surface element.

25. The engine transmission and speed control unit of claim 24 wherein the electronic controller is further configured to transmit a repositioning signal to the drive motor to cause the drive motor to position the pivotable base portion so that one of a voltage and a current measured at the engagement of the second wiper assembly and the second resistive surface element matches the one of the voltage and the current measured at the engagement of the first wiper assembly and the first resistive surface element.

26. The engine transmission and speed control unit of claim 22 wherein the lever arm is movable with respect to the stationary base to effectuate at least one of a forward, a neutral, and a reverse gear position.

27. The engine transmission and speed control unit of claim 26 further comprising a pair of springs disposed between the pivotable base portion and the lever arm.

* * * * *

UNITED STATES PATENT AND TRADEMARK OFFICE

CERTIFICATE OF CORRECTION

PATENT NO. : 6,485,340 B1
DATED : November 26, 2002
INVENTOR(S) : Kolb et al.

It is certified that error appears in the above-identified patent and that said Letters Patent is hereby corrected as shown below:

Column 4,
Line 31, delete “ill” and substitute therefor -- in --;
Line 61, delete “to” and substitute therefor -- the --;

Column 5,
Line 44, delete “throw” and substitute therefor -- thereof, --;

Column 6,
Line 47, delete “fir&a” and substitute therefor -- first --;
Line 60, after the word “position”, insert -- of said --;

Column 8,
Line 61, delete “age” and substitute therefore -- linkage --.

Signed and Sealed this

Fourth Day of March, 2003

*Attest:*

*Attesting Officer*

JAMES E. ROGAN
*Director of the United States Patent and Trademark Office*